US008664171B2

(12) United States Patent
Stevenson et al.

(10) Patent No.: US 8,664,171 B2
(45) **Date of Patent: *Mar. 4, 2014**

(54) NITRATED EXTREME PRESSURE ADDITIVES AND BLENDS

(75) Inventors: Donald Stevenson, Dover, OH (US); Duong N. Nguyen, Dover, OH (US)

(73) Assignee: Dover Chemical Corporation, Dover, OH (US)

( * ) Notice: Subject to any disclaimer, the term of this patent is extended or adjusted under 35 U.S.C. 154(b) by 818 days.

This patent is subject to a terminal disclaimer.

(21) Appl. No.: 12/188,825

(22) Filed: Aug. 8, 2008

(65) Prior Publication Data

US 2008/0305974 A1 Dec. 11, 2008

Related U.S. Application Data

(63) Continuation-in-part of application No. 11/626,502, filed on Jan. 24, 2007, now Pat. No. 7,960,323.

(60) Provisional application No. 60/766,581, filed on Jan. 30, 2006.

(51) Int. Cl.
*C10M 133/32* (2006.01)
*C10M 159/18* (2006.01)

(52) U.S. Cl.
USPC ..... 508/549; 508/454; 508/543

(58) Field of Classification Search
USPC ..... 508/454, 491, 549, 543, 545, 548, 550, 508/551
See application file for complete search history.

(56) References Cited

U.S. PATENT DOCUMENTS

| | | | | |
|---|---|---|---|---|
| 2,196,101 | A * | 4/1940 | Carmichael et al. | 508/477 |
| 2,340,331 | A * | 2/1944 | Knutson et al. | 508/433 |
| 3,221,062 | A * | 11/1965 | Wright | 568/706 |
| 4,347,148 | A * | 8/1982 | Davis | 508/549 |
| 4,534,873 | A | 8/1985 | Clark | |
| 4,844,825 | A | 7/1989 | Sloan | |
| 5,144,082 | A * | 9/1992 | Forbus et al. | 568/785 |
| 5,332,516 | A | 7/1994 | Stephens | |
| 5,759,965 | A * | 6/1998 | Sumiejski | 508/186 |
| 6,005,144 | A * | 12/1999 | Kropp et al. | 564/485 |
| 6,028,038 | A | 2/2000 | Kusch | |
| 7,960,323 | B2 * | 6/2011 | Nguyen | 508/454 |
| 8,058,317 | B2 * | 11/2011 | Nguyen | 516/67 |

OTHER PUBLICATIONS

Tribology & Lubrication Technology (Nov. 2007).

* cited by examiner

*Primary Examiner* — Pamela H Weiss
(74) *Attorney, Agent, or Firm* — Hahn Loeser & Parks LLP

(57) ABSTRACT

This invention relates to products useful in friction-reducing extreme-pressure lubricating applications such as internal combustion engines, gear oils and applications which involve rubbing metallic moving parts. The invention includes additive blends and a process of using synergistic combinations of nitro compounds with non-chlorine containing additives such as sulfur-containing moieties and phosphorus-containing moieties.

3 Claims, No Drawings

NITRATED EXTREME PRESSURE ADDITIVES AND BLENDS

CROSS-REFERENCE TO RELATED APPLICATIONS

This application claims priority to and is a continuation-in-part application of U.S. patent application Ser. No. 11/626,502 filed 24 Jan. 2007, now U.S. Pat. No. 7,960,323, the contents of which are fully incorporated by reference, and which claims priority to U.S. Provisional patent application Ser. No. 60/766,581, filed 30 Jan. 2006, now expired.

TECHNICAL FIELD

This invention relates generally to the use of oil-based nitrated extreme pressure (hereinafter "EP") additives and blends for use with internal combustion engines, gear oils, and all metallic moving or rubbing parts which fulfill the conditions of boundary lubrication in which the active elements in the lubricating oil chemically reacting to the metal surfaces, optionally in synergistic combination with other chlorine-free EP additives.

BACKGROUND OF THE INVENTION

It is known that certain chlorine-based compounds, such as chlorine derivates of paraffinic hydrocarbon compounds referred to as chlorinated paraffins, can serve as lubricant additives to improve the performance of the lubricant under extreme pressure. Under normal lubricating conditions, the two metal surfaces will be separated by a thin film of lubricant which provides the required reduction in friction. Under situations of extreme pressure between the two metal surfaces, all the liquid lubricant is forced from the area of contact between the surfaces. Where an extreme pressure additive such as chlorinated paraffin is present, however, it has been found that the resultant heat generated between the two surfaces causes chlorine atoms to be liberated from the additive and to combine with the surface metal, such as iron, to form a chloride, such as iron chloride. This surface coating of chloride has a much lower coefficient of friction than the dry metal surface. The iron chloride surface coating tends to fill in depressions in the surfaces, resulting in smoother surfaces at the point of interaction and reduced friction and wear.

Chlorinated paraffins have been used as extreme pressure additives in such applications as metal-working. However, the corrosive nature of chlorinated paraffins have made them generally unsuitable for use in internal combustion engine applications or other corrosion-sensitive applications. Under heating, the chlorinated paraffins release hydrochloric acid, which is corrosive.

The lubrication regime described herein falls into the category of a boundary lubrication in which there is intimate or severe contact between two dissimilar metal surfaces or objects under high pressure, and in which the EP lubricant additives react to form metallic oxides generating sacrificial layers which are responsible for the lubricating performance. Therefore, the end-use applications which are particularly suited to this invention include, but are not limited to, internal combustion engines, transmission systems, gear boxes, bearings, etc. Lubricating oils typically also contain one or more of the following additives: boundary additives, corrosion inhibitors, anti-oxidants, dispersants, anti-wear additives, and extreme-pressure ("EP") additives. Boundary, antiwear, and extreme-pressure additives are typically grouped as performance additives while the others as functional additives.

This invention pertains to the use of nitrated extreme-pressure additives particularly in internal combustion engines, gear oils, as well as applications involving rubbing metal moving parts.

Presently, commercial extreme-pressure additives contain one or more sulfur, chlorine, or phosphorus-containing compounds. Sulfur-containing additives are sulfurized fat or fatty esters or synthetic polysulfides; chlorine-containing additives are chlorinated paraffins, olefins, or chlorinated fatty compounds; while phosphorus-containing additives consist of phosphate esters and phosphites. Each of the above-mentioned commercial extreme-pressure additives has its own set of limitations.

Sulfurized additives are effective for working with steel parts but not those involving stainless steel or special alloys such as titanium, chromium, or nickel-based, especially those in the most severe working environments. Phosphate esters or phosphites are excellent anti-wear or load-carrying additives but only in light-duty applications. For most cases, they are not effective extreme-pressure additives and definitely unsuitable for applications involving stainless steel. One of the reasons is that these phosphorus and sulfur-containing additives are not very reactive to hardened steel or low-iron metallic composites such as stainless or special alloys mentioned above. Chlorinated compounds, on the other hand, are very effective in wide range of metal processing applications involving both steel, stainless steel, and special alloys. The rule of thumb in the industry is that chlorinated additives are required for working with these exotic alloys of low or no iron content. However, recent environmental concern regarding the disposal of chlorinated compounds has prompted the lubricant industry to search for alternatives to replace the chlorinated additive workhorse.

This invention describes a novel class of extreme-pressure additives, labeled generically as "nitrated" or nitro compounds. The nitro compounds cited in this invention can be made by using 70% nitric acid or nitrogen dioxide gas to nitrate many classes of compounds, such as: (1) fatty acids with unsaturation; (2) fatty oils which contain unsaturation sites on their hydrocarbon chains such as vegetable oils, tall oil and animal fats; (3) esters (synthetic or natural) derived from the reaction of alcohols with fatty acids, such as triglycerides; (4) $C_2$-$C_{28}$ simple terminal or internal olefins, more preferably $C_8$-$C_{18}$ olefins; (5) $C_2$-$C_{20}$ polyolefins or $C_4$-$C_{20}$ polydiolefins, more preferably $C_2$-$C_6$ polyolefins containing terminal or internal unsaturation, preferably polyisobutylene (hereinafter "PIB"); (6) $C_8$-$C_{20}$ copolymers derived from polyolefins and vinyl aromatics e.g., poly(styrene butadiene); and (7) $C_4$-$C_{30}$ alkylated phenols, e.g., nonyl phenol and wherein the alkyl group is a straight or branched chain.

At least one novel feature of this additive is that it contains nitro-compounds instead of conventional elements such as sulfur, chlorine, or phosphorus, and has demonstrated its effectiveness as an extreme-pressure additive capable of replacing (either completely or at least partially) both sulfurized, chlorinated, and phosphated additives for use in internal combustion engines, both steel and stainless steel applications, for aluminum applications, as well as for processing metallic alloys which are currently considered as most challenging such as titanium, nickel, and chromium-based metals or alloys.

In one embodiment of the invention, these additives can be used synergistically with at least one non-chlorine containing additive. At least one feature of the nitrated additive is that it contains no or reduced amounts of conventional elements such as sulfur, chlorine, or phosphorus, and has demonstrated its effectiveness as an extreme-pressure additive capable of replacing or partially replacing sulfurized, phosphated, and primarily chlorinated EP additives for both steel and stainless steel, as well as the above-mentioned non-ferrous applications. In one preferred embodiment of the invention, this additive is used either by itself, or in synergistic combinations, in internal combustion engines, gear oils, and metallic applications wherein metal-to-metal contact is inherent, and in which the active elements in the lubricating oil chemically react with the metal surfaces.

SUMMARY OF THE INVENTION

An object of this invention is to illustrate a process to produce the novel oil-based generically-called "nitrated" or more scientifically accurately as "nitro" additives by nitrating fatty raw material sources such as animal fats, vegetable oils, the fatty acids and synthetic esters derived therefrom, terminal or internal olefins, polyalkenes or their linear copolymers, and alkylated phenols, using 70% nitric acid or nitrogen dioxide gas which is the anhydrous form of nitric acid as the nitrating agent.

Another object of this invention is to illustrate the novel uses of these above-mentioned oil-based nitro additives as the extreme-pressure or EP additives in various industrial lubricants such as engine oils, hydraulic fluids, gear oils, chain oils, drilling muds, and the like, and also as metal working fluids for various kinds of metals, including both ferrous and non-ferrous, and their alloys, particularly aluminum, stainless steel, titanium, nickel, and chromium alloys.

A further object of this invention is to illustrate the novel use of these above-mentioned oil-based nitro additives as extreme-pressure or EP additives in various industrial lubricants and metal working fluids, in the form of soluble oils or as lubricating blends which contain the novel nitro EP additives and emulsifiers together blended into an oil-based carrier of petroleum oils or synthetic esters.

A still further object of this invention is to illustrate the novel uses of these above-mentioned oil-based nitro additives as extreme-pressure or EP additives in synergy with conventional EP or lubricating additives such as sulfurized and phosphated additives, both in straight-oil and soluble oil formulas.

Yet still another object of this invention is to illustrate the novel uses of nitro-compounds as a new class of antiwear/extreme-pressure (EP) additives which can partially or totally replace both sulfurized and/or phosphorus-containing and/or chlorinated additives, in a wide variety of industrial lubricants and metal working fluids, both oil-based and water-based, such as engine oils, hydraulic fluids, gear oils, chain oils, two-cycle engine oils, cutting fluids, drawing compounds, and the like.

These and other objects of the present invention will become more readily apparent from a reading of the following detailed description taken in conjunction with the appended claims.

DETAILED DESCRIPTION OF THE INVENTION

The nitration process of the instant invention is carried out with many classes of compounds, an exemplary listing including: $C_2$-$C_{30}$ unsaturated fatty acids; $C_2$-$C_{30}$ unsaturated fatty oils or glycerides; esters derived from the reaction of $C_1$-$C_{20}$ alcohols with $C_2$-$C_{30}$ unsaturated fatty acids; $C_2$-$C_{28}$ terminal or internal olefins; $C_2$-$C_{20}$ polyolefins; $C_4$-$C_{20}$ polydiolefins; $C_8$-$C_{20}$ copolymers derived from polyolefins and vinyl aromatics; and $C_4$-$C_{30}$ alkylated phenols.

In a more preferred embodiment, the classes would include: $C_8$-$C_{30}$ unsaturated fatty acids; $C_8$-$C_{30}$ unsaturated fatty oils or natural triglycerides; esters derived from the reaction of $C_4$-$C_{20}$ alcohols with unsaturated $C_8$-$C_{30}$ fatty acids; $C_4$-$C_{18}$ terminal or internal olefins; $C_4$-$C_{18}$ polyolefins; $C_4$-$C_{18}$ polydiolefins; $C_8$-$C_{20}$ copolymers derived from polyolefins and vinyl aromatics; and $C_8$-$C_{20}$ alkylated phenols.

The nitrating agent can be nitric acid or nitrogen dioxide gas. When nitric acid is used as the nitrating agent, various concentrations ranging from 30% to 70% are useful in this invention.

Fatty oils suitable for the nitration have a certain degree of unsaturation or some double bonds in their hydrocarbon chains and include animal fats, vegetable oils such as soybean oil, corn oil, canola oil, castor oil, tall oil, and all similar unsaturated triglycerides.

Synthetic esters are normally derived from reacting various alcohols such methanol, butanol, 2-ethylhexanol, trimethylolpropane, pentaerythritol, sorbitol, and the like with fatty acids such as oleic acid, tall oil fatty acid, linoleic acid, linolenic acid, palmitoleic, arachidonic acid, castor oil fatty acid, tall-oil-derived dimmer acids, alkylated succinic anhydride and acids, and mixtures thereof. Illustrative examples of fatty acid esters include, but are not limited to methyl oleate, methyl soyate, methyl tallowate, methyl tallate, trimethylolpropane unsaturated esters, pentaerythritol tetraesters, diethylene glycol esters, propyleneglycol esters and 2-ethylhexyl esters.

Simple alkenes or olefins include both terminal and internal ones with carbon chain length ranging from $C_4$ to $C_{28}$.

Polyalkenes useful in this invention are preferably polybutenes or polyisobutylenes with molecular weights ranging from 300 to 4500, with 300 to 1000 preferred. Also suitable for nitration are the polymers of other alkenes or $C_2$-$C_6$ olefins such as polyethylenes, polypropylenes, polypentenes, polyhexenes, poly(methyl-2-butene), poly(ethyl-1-butene) and mixtures and blends thereof as well as polydienes, e.g., polybutadiene and polyisoprene and blends thereof.

Copolymers useful in this invention can have terminal or internal double bonds of $C_8$ to $C_{20}$ chain lengths being preferred. The polymers can be either straight or branched chain, e.g., poly(styrene butadiene), and the like, as well as mixtures and blends thereof.

The nitrating agents can be commercial nitric acid with 70% strength which can be used at 70% or be diluted further with water to 30%. The anhydrous form of nitric acid, known as nitrogen dioxide gas ($N_2O_4$) can also be used in place of nitric acid.

No catalyst was used in any nitration processes for making the novel extreme-pressure additives useful in this invention.

To distinguish the nitro-compounds, it is noted that there are similar but different nitrogen-containing chemicals, namely nitrite and nitrates. Nitrous acid ($HNO_2$) can be esterified with alkyl alcohols to yield nitrites which contain C—O bonds and the final functional group of nitrites can be schematically described as —C—O—N═O. Nitric acid ($HNO_3$) can be esterified with the same alcohols to yield nitrates which also contain C—O bonds and their functional groups can be described as —C—O—$NO_2$. On the other hand, nitric acid can undergo the electrophilic substitution or via free radical reaction to form nitro compounds which contain C—N bonds and of which the functional groups can be described as —C—$NO_2$.

Nitric acid or nitrogen oxides can induce both electrophilic substitution and free radical attacks on hydrocarbon chains, therefore, without being held to any one particular theory of operation, or mechanism, the generic nitration reaction to render the nitro compounds used in this invention can be generalized in broad terms as follows:

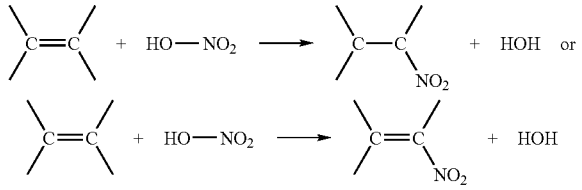

What is important is that the starting reactant (Formula II) contain at least one unsaturated site, and that post nitration reaction, the additive contains the —C—$NO_2$ or nitro group. The completion of the nitration reaction can be observed by monitoring the nitro functional group using Fourier Transform Infra-Red ("FTIR") registered at 1551-1554 $cm^{-1}$ in contrast to 1631 $cm^{-1}$ for nitrate or —C—O—$NO_2$ group, or by monitoring the decreasing acidity of the reacting medium, or by measuring the amount of water collected which will come from two sources, the 30% water existing in the starting 70% nitric acid from the beginning and the water generated as the by-product of the nitration process. This collected water is measured and tabulated as the percent of nitric acid charged. Theoretically, the total water collected is calculated to be equal to 50% of the initial nitric acid charge. However, the yield of the nitration reaction will be slightly less than the theoretical yield due to the loss of the starting raw materials. Some nitric acid will also be lost as the gaseous oxides of nitrogen, and some nitrated organic compounds will be lost due to depolymerization or breaking down of hydrocarbon chains due to free radical degradation.

Two nitration methods are used and being described here, one is carried out at 70° C. while the other at 110° C. Also, various molar ratios between nitric acid and nitrated organics, i.e., various degrees of nitration are employed to demonstrate the great flexibility of the nitration method and broaden its scope. The charge of 70% nitric acid is not calculated based on the molecular weight of the nitrated organics but rather based on its unsaturation content or the amount of double bonds existing on the molecular chains. In some instances, the starting compounds become fully nitrated, but in most cases, the degree of nitration is preferred to be at approximately between 35-50% of the degree of unsaturation due to the exothermic nature of nitration and also due to the accelerated degradation caused by such a strong oxidizing agent as concentrated nitric acid.

Typically, at 70° C., a compound which is to be nitrated is selected from fatty oils, PIB, olefins, or alkylated phenols and is charged along with 70% nitric acid. The reacting medium is then heated to 70° C., held at that temperature for 6-8 hours. Subsequently the temperature is slowly increased to 120° C. The batch is held there for about one hour before being cooled to 80° C. Air or nitrogen is then introduced to blow out and remove essentially all entrapped water, which is collected in a Dean-Stark trap, to render a final product. Alternatively, vacuum can be applied for a similar purpose.

If the nitration is carried out at 110° C. or higher, the initial starting organic is heated to 110° C., followed by the addition of a pre-measured amount of 70% nitric acid (which is added slowly) with some cooling to maintain the reacting medium at 100-120° C. After all the nitric acid is charged, the batch is then slowly heated to 120° C., and held at that temperature for about one hour before gas blowing is introduced to remove the water by-product.

The invention is now described in more detail with reference to the following non-limiting examples.

Oil-Based Extreme-Pressure Additives

Example #1

Nitrated Soybean Oil

To a three-necked round bottom flask, equipped with a thermometer, stirring bar, Dean-Stark trap, gas sparger, and a condenser, 89.0 g (0.100 mole) of refined soybean oil and 16.1 g (0.179 mole) of 70% nitric acid were charged. The batch was heated to and maintained at 25-140° C., preferably at 60-120° C., more preferably at 70° C. for eight hours. Subsequently the temperature of the reaction was slowly increased to 100° C. The batch was maintained at 100° C. for two hours before cooling to 80° C. The batch was air-blown to remove essentially all entrapped water. A total of 8.0 g water was collected. The total weight loss was 8.7 g or 54% based on the weight of the nitric acid charge. The final yield was 96.5 g of dark brown fluid which FTIR at 1551-1554 $cm^{-1}$ indicated contained the nitro group (C—$NO_2$). The total nitric acid charge amounted to 18% by the weight of the starting organic.

Example #2

Nitrated Soybean Oil

To a three-necked round bottom flask, equipped with a thermometer, stirring bar, Dean-Stark trap, gas sparger, and a condenser, 50.0 g (0.056 mole) of refined soybean oil and 13.2 g (0.147 mole) of 70% nitric acid were charged. The batch was heated to and maintained at 70° C. for eight hours. Subsequently the temperature of the reaction was slowly increased to 100° C. The batch was maintained at 100° C. for two hours before cooling to 80° C. Finally, the batch was air-blown or vacuum applied to remove essentially all entrapped water. A total of 6.6 g water was collected. The total weight loss was 11.4 g or 57% based on the weight of the nitric acid charge. The final yield was 55.6 g of dark brown fluid which FTIR at 1551-1554 $cm^{-1}$ indicated contained the nitro group (C—$NO_2$). The total nitric acid charge amounted to 26% by the weight of the starting organic.

Example #3

Nitrated Soybean Oil

To a three-necked round bottom flask, equipped with a thermometer, stirring bar, Dean-Stark trap, gas sparger, and a condenser, 50.0 g (0.056 mole) of refined soybean oil and 20.0 g (0.222 mole) of 70% nitric acid were charged. The batch was heated to and maintained at 70° C. for eight hours. Subsequently, the temperature of the reaction was slowly increased to 100° C. The batch was maintained at 100° C. for two hours before cooling to 80° C. The batch was air-blown or vacuum applied to remove essentially all entrapped water. A total of 10.0 g water was collected. The total weight loss was 11.4 g or 57% based on the weight of the nitric acid charge. The final yield was 58.6 g of dark brown fluid which FTIR at 1551-1554 $cm^{-1}$ indicated contained the nitro group (C—$NO_2$). The total nitric acid charge amounted to 40% by the weight of the starting organic.

Example #4

Nitrated Esters of Trimethylol Propane and Oleic Acid

To a three-necked round bottom flask, equipped with a thermometer, stirring bar, Dean-Stark trap, gas sparger, and a condenser, 53.0 g (0.059 mole) of FL-216 (Dover Chemical's synthetic esters of trimethylolpropane and oleic acid) was added. The batch was heated to 110° C. and 5.3 g (0.059 mole) of 70% nitric acid was charged slowly to keep the temperature between 100-120° C. After all nitric acid was added, the batch was maintained at 110° C. for two hours before cooling to 80° C. The batch was air-blown or vacuum applied to remove essentially all entrapped water. A total of 2.6 g water was collected. The total weight loss was 2.8 g or 53% based on the weight of the nitric acid charge. The final yield was 55.5 g of light brown fluid which FTIR at 1551-1554 $cm^{-1}$ indicated contained the nitro group ($C—NO_2$). The total nitric acid charge amounted to 10% by the weight of the starting organic.

Example #5

Nitrated Esters of Trimethylol Propane and Oleic Acid

To a three-necked round bottom flask, equipped with a thermometer, stirring bar, Dean-Stark trap, gas sparger, and a condenser, 61.6 g (0.069 mole) of FL-216 (Dover Chemical's synthetic esters of trimethylolpropane and oleic acid) was added. The batch was heated to 110° C. and 9.2 g (0.102 mole) of 70% nitric acid was charged slowly to keep the temperature between 100-120° C. After all nitric acid was added, the batch was maintained at 110° C. for two hours before cooling to 80° C. The batch was air-blown or vacuum applied to remove essentially all entrapped water. A total of 4.6 g water was collected. The total weight loss was 4.8 g or 52% based on the weight of the nitric acid charge. The final yield was 65.8 g of light brown fluid which FTIR at 1551-1554 $cm^{-1}$ indicated contained the nitro group ($C—NO_2$). The total nitric acid charge amounted to 15% by the weight of the starting organic.

Example #6

Nitrated Esters of Trimethylol Propane and Oleic Acid

To a three-necked round bottom flask, equipped with a thermometer, stirring bar, Dean-Stark trap, gas sparger, and a condenser, 50.9 g (0.057 mole) of FL-216 (Dover Chemical's synthetic esters of trimethylolpropane and oleic acid) was added. The batch was heated to 110° C. and 13.2 g (0.147 mole) of 70% nitric acid was charged slowly to keep the temperature between 100-120° C. After all nitric acid was added, the batch was maintained at 110° C. for two hours before cooling to 80° C. The batch was air-blown or vacuum applied to remove essentially all entrapped water. A total of 6.6 g water was collected. The total weight loss was 7.1 g or 54% based on the weight of the nitric acid charge. The final yield was 56.9 g of light brown fluid which FTIR at 1551-1554 $cm^{-1}$ indicated contained the nitro group ($C—NO_2$). The total nitric acid charge amounted to 26% by the weight of the starting organic.

Example #7

Nitrated Polyisobutylene

To a three-necked round bottom flask, equipped with a thermometer, stirring bar, Dean-Stark trap, gas sparger, and a condenser, 86.1 g (0.287 mole) of polyisobutylene (MW avg.=300) and 25.8 g (0.287 mole) of 70% nitric acid were charged. The batch was heated to and maintained at 70° C. for eight hours. The temperature of the reaction was slowly increased to 100° C. and maintained at that temperature for two hours before cooling to 80° C. The batch was air-blown or vacuum applied to remove essentially all entrapped water. A total of 12.9 g water was collected. The total weight loss was 17.3 g or 67% based on the weight of the nitric acid charge. The final yield was 94.5 g of dark yellow fluid which FTIR at 1551-1554 $cm^{-1}$ indicated contained the nitro group ($C—NO_2$). The total nitric acid charge amounted to 30% by the weight of the starting organic.

Example #8

Nitrated Polyisobutylene

To a three-necked round bottom flask, equipped with a thermometer, stirring bar, Dean-Stark trap, gas sparger, and a condenser, 136.3 g (0.136 mole) of polyisobutylene (MW avg.=1000) and 13.8 g (0.153 mole) of 70% nitric acid were charged. The batch was heated to and maintained at 70° C. for eight hours. The temperature of the reaction was slowly increased to 100° C. and maintained at that temperature for two hours before cooling to 80° C. The batch was air-blown or vacuum applied to remove essentially all entrapped water. A total of 6.9 g water was collected. The total weight loss was 8.1 g or 59% based on the weight of the nitric acid charge. The final yield was 142.0 g of light yellow fluid which FTIR at 1551-1554 $cm^{-1}$ indicated contained the nitro group ($C—NO_2$). The total nitric acid charge amounted to 10% by the weight of the starting organic.

Example #9

Nitrated $C_{18}$ Alpha-Olefins

To a three-necked round bottom flask, equipped with a thermometer, stirring bar, Dean-Stark trap, gas sparger, and a condenser, 63.8 g (0.253 mole) of $C_{18}$ alpha-olefin was charged. The batch was heated to 110° C. and 22.7 g (0.252 mole) of 70% nitric acid was charged slowly to keep the temperature between 100-120° C. After all nitric acid was added, the batch was maintained at 110° C. for two hours before cooling to 80° C. The batch was air-blown or vacuum applied to remove essentially all entrapped water. A total of 11.3 g water was collected. The total weight loss was 13.1 g or 58% based on the weight of the nitric acid charge. The final yield was 73.2 g of light brown fluid which FTIR at 1551-1554 $cm^{-1}$ indicated contained the nitro group ($C—NO_2$). The total nitric acid charge amounted to 35% by the weight of the starting organic.

Example #10

Nitrated Oleic Acid

To a three-necked round bottom flask, equipped with a thermometer, stirring bar, Dean-Stark trap, gas sparger, and a condenser, 77.2 g (0.271 mole) of oleic acid was charged. The batch was heated to 110° C. and 17.7 g (0.197 mole) of 70% nitric acid was charged slowly to keep the temperature between 100-120° C. After all nitric acid was added, the batch was maintained at 110° C. for two hours before cooling to 80° C. The batch was air-blown or vacuum applied to remove essentially all entrapped water. A total of 8.8 g water was collected. The total weight loss was 9.9 g or 56% based on the weight of the nitric acid charge. The final yield was 84.9 g of dark brown fluid which FTIR at 1551-1554 $cm^{-1}$ indicated contained the nitro group (C—$NO_2$). The total nitric acid charge amounted to 23% by the weight of the starting organic.

Example #11

Nitrated Nonyl Phenol

To a three-necked round bottom flask, equipped with a thermometer, stirring bar, Dean-Stark trap, gas sparger, and a condenser, 100.0 g (0.457 mole) of nonyl phenol was charged. At room temperature, 35.0 g (0.167 mole) of 30% nitric acid was charged slowly to keep the temperature below 100° C. After all nitric acid was added, the batch was maintained at 90° C. for two hours before cooling to 80° C. The batch was air-blown or vacuum applied to remove essentially all entrapped water. A total of 26.1 g water was collected. The final yield was 106.3 g of dark brown fluid which FTIR at 1551-1554 $cm^{-1}$ indicated contained the nitro group (C—$NO_2$). The total nitric acid charge amounted to 15% by the weight of the starting organic.

What has been shown is that nitric acid can react with: (a) animal fat or glycerides from animal fat such as lard, pigskin grease, chicken fat, cod or fish oil, sheep fat, blubber, etc.; (b) vegetable oils including oils from oilseeds, such as cashew, castor bean, castor oil, flax seed—linseed oil, grape seed—grape seed oil, hemp (cannabis), mustard olives and olive pits—olive oil, poppy seeds—poppyseed oil, rapeseed, canola (cultivar of rapeseed), safflower, sesame seed, sunflower, as well as other vegetable oils such as almond, apricot, argan, avocado, corn (maize)—corn oil, cotton plant seed—cottonseed oil, coconut—coconut oil, fusarium—actually a fungus, hazelnut, neem oil, palm—palm oil—from the fruit of the African palm tree, palm kernel oil—from the seed of the African palm tree, peanut—peanut oil, pumpkin seed, rice bran, soybean—soybean oil is commonly marketed as "Vegetable Oil", walnut, canola, soybean oil, corn oil, etc.; (c) olefins, internal or alpha, short chain or polymers including polyalkylene oxides, polyalkylenes, polyalkylated aromatics, etc.; and (d) unsaturated hydrocarbons, including alkenes, arylalkyls, alkylaryls, etc.

High rosin fatty acids may be substituted in whole or in part for non-high rosin fatty acids used in embodiments described elsewhere herein. It is recognized that sources of $C_6$-$C_{24}$ fatty acids include, but are not limited to, those obtained from natural sources such as animal tallows and greases, vegetable, coconut, palm, marine oils, etc. Such acids may also be produced synthetically from petroleum sources. For example, fatty acids may be produced by oxidation of hydrocarbons.

This embodiment of the invention describes the reactions and reactant yields between nitric acid and fatty compounds in which nitric acid charge can range from 0.1 mole to 3.0 mole for each mole of triglycerides or 0.1 to 1.0 mole of nitric acid for each mole of fatty acids/esters, alcohols, or olefins.

What is also known is that nitric acid can oxidize essentially all organic matter, particularly hydrocarbons, and therefore, this chemical reaction extends to any chemical that contains a hydroxyl group, hydroalkyl chain, or alkyl group that can be reacted with nitric acid to provide a nitrated additive of this invention. These nitrated hydrocarbons are useful as the extreme-pressure additives of the instant invention.

The hereinabove described portion of the invention describes the use of the above-mentioned oil-based nitro extreme-pressure additives in a lubricant formulation for metal processing applications, for an industrial lubricating formula or other applications requiring the use of a lubricant and which are an effective partial or total replacement for the currently available chlorinated, sulfurized, and phosphated compounds, usable in steel, stainless steel, special non- or low-ferrous alloy processing applications. This interchangeability of the novel nitro EP towards the conventional EP additives is due to the synergism between the novel additive and other traditional ones.

Extreme-pressure testing equipment and testing protocol for determining the applicability of use of the EP additives in internal combustion engine oils, gear oils, and high pressure rubbing metal moving part oils, use the mechanical parts and set-up similar to the European Reichert test. In this test, through a lever arm, an extreme pressure is generated upon a stationary steel bearing roller (cylinder) which is placed and pressed upon a rotating steel bearing race or cup. The applied loads, ranging from 2 lbs to 20 lbs, are mounted on one end of the lever arm resulting in the extremely high pressures at the point of contact between the stationary bearing roller or cylinder and the rotating bearing race or cup. The rotating bearing race is always half immersed in the tested lubricating oils. Thus, at any given time, the point of contact between two bearings is always well lubricated. With a good friction-reducer or EP lubricating additive package, the tester runs very smoothly with very little noise. The scar created on the stationary bearing roller would be very small, less than 1 mm width and very smooth. With a bad or ineffective EP lubricating package, the tester becomes very noisy during a run or the two bearings are literally seized up altogether. The scar in this failure case is very large and rough, at about 3-5 mm in width. This simple tester was proven to simulate very well the intimate contact between pistons and engine walls of an internal combustion engine.

As taught in this disclosure, and unlike chlorinated extreme-pressure (EP) additives, nitrated or nitro-EP additives do not promote corrosion on steel metal surfaces. The last mentioned non-corrosiveness feature is at least part of the novelty of the nitro EP additive (and blends) disclosed herein.

Tested EP Additives:

The following EP additives were specifically tested, the additive added between approximately 2% and 75% by weight:

(1) Paroil® 56 NR—Dover Chemical Corporation's chlorinated paraffin containing 56% chlorine (Paroil® is Dover Chemical's name for liquid chlorinated paraffins, and is based on the chlorination of waxes and normal paraffins. A variety of products are available with chlorine contents from 40 to 70 percent and with viscosities from 2 to 1000 poise at 25° C.);

(2) Doverlube® NCEP—Dover Chemical Corporation's nitrated soybean oil containing 1.5% nitrogen;

(3) Doverlube® 3208—Dover Chemical Corporation's alkyl amine sulfamate;

(4) Synacto® 416—Infinium Corporation's sodium alkyl sulfonates;

(5) EM-706—Dover Chemical Corporation's ethoxylated phosphate esters containing 7% phosphorus;

(6) Doverlube® TNPPT—Dover Chemical Corporation's tris nonylphenyl thiophosphate containing 4% sulfur and 4% phosphorus;

(7) Doverphos® TNPP—Dover Chemical Corporation's tris nonylphenyl phosphite containing 4% phosphorus;

(8) Elco™ 102—Elco Corporation's zinc dithiophosphate or ZDDP; and (9) Doverfax™ 100—Dover Chemical Corporation's epoxidized soybean oil.

TABLE I

EP Testing Results with Texaco's Halvoline 5W40 petroleum-based motor oil

| Run | Friction-Reducing EP oil blends | Failure loads in lbs |
|---|---|---|
| 1 | 50% 5W40 motor oil + 50% Paroil 56NR | No failure load, >20 lbs |
| 2 | 50% 5W40 motor oil + 50% Doverlube NCEP | 4 |
| 3 | 50% 5W40 motor oil + 25% Doverlube NCEP + 25% Doverlube 3208 | No failure load, >20 lbs |
| 4 | 50% 5W40 motor oil + 25% Doverlube NCEP + 25% Synacto 416 | 12 |
| 5 | 50% 5W40 motor oil + 25% Doverlube NCEP + 25% Doverlube EM-706 | No failure load, >20 lbs |
| 6 | 50% 5W40 motor oil + 25% Doverlube NCEP + 25% Doverlube TNPPT | No failure load, >20 lbs |
| 7 | 50% 5W40 motor oil + 25% Doverlube NCEP + 25% Elco's ZDDP | No failure load, >20 lbs |
| 8 | 50% 5W40 motor oil + 25% Doverlube NCEP + 25% Doverphos TNPP | 8 |
| 9 | 50% 5W40 motor oil + 25% Doverlube NCEP + 25% Epoxidized soybean oil | 4 |
| 10 | 100% 5W40 motor oil | 2 |

In Run #1 of Table 1, the blend of chlorinated paraffin in motor oil performed well in the extreme-pressure test, giving no failure load or exceeding 20 lbs maximum. This blend was used as the standard for comparative purposes. In Run #2, the 50% blend of Doverlube NCEP or nitro soybean oil in motor oil performed poorly, but still better than motor oil without any additive. Nitro soybean appeared too aggressive to ferrous surfaces of steel parts. Run #3 illustrated the additive blend of Doverlube NCEP and Doverlube 3208 or alkyl amine sulfamate in motor oil and the results indicate that the combination performed very well, yielded no failure. Run #4, the blend of Doverlube NCEP and Synacto 416 (sodium alkyl sulfonate), did not perform as well as other combinations, yet still better than motor oil without any additive. In Run #5, the blend of nitro soybean oil (Doverlube NCEP) and EM 706 (ethoxylated phosphate esters) did well, and yielded no failure. This experiment illustrates that Nitro EP additives work well synergistically with phosphates. In Run #6, the blend of nitro soybean oil and TNPPT (tris nonylphenyl thiophosphate) yielded no failure load. Again, nitro EP additives work well with phosphates. In Run #7, the blend of nitro soybean oil and the commercial zinc dithiophosphate (ZDDP) did well, and yielded no failure load. Again, the experiment illustrates that nitro EP additives work well with phosphates. In Run #8, the blend of nitro soybean oil and TNPP (tris nonylphenyl phosphate), the precursor of TNPPT, did not perform well. The difference between TNPP and TNPPT is that the former phosphorus is in a 3-plus valency while phosphorus in the latter is in a 5-plus valency state. In Run #9, the blend of nitro soybean oil and epoxidized soybean oil, performed similarly to straight nitro soybean oil, which illustrated poor performance. Run #10, motor oil without any additional additive, was used as the benchmark against which to measure performance.

Thus, what is illustrated is the following: (1) the synergy between nitro EP additives and phosphates, thiophosphates, and sulfamates; (2) the effectiveness of the EP blends including nitro-EP in enhancing the performance of motor oils for crankcase application; and (3) the effectiveness of the EP blends to perform similarly to chlorinated paraffins in lubricating internal combustion engines.

TABLE II

EP Testing Results with Shell's Rotella T 5W30 synthetic-based motor oil

| Run | Friction-Reducing EP oil blends | Failure loads in lbs |
|---|---|---|
| 1 | 100% 5W30 synthetic motor oil | Failed at 9 lbs load |
| 2 | 90% 5W30 synthetic motor oil + 10% Doverlube NCEP | Failed at 12 lbs load |
| 3 | 90% 5W30 synthetic motor oil + 5% Doverlube NCEP + 5% tert-nonylpolysulfide (20% S) | No failure load, >20 lbs |
| 4 | 90% 5W30 synthetic motor oil + 10% Paroil 56 NR | No failure load, >20 lbs |

A comparison between Run 3 and Run 2 clearly indicate the synergism between nitro-EP or Doverlube NCEP and their performance as an EP blend in motor oil. A comparison between Run 4 and Run 3 shows the equivalent extreme-pressure properties between NCEP/polysulfide blend to the chlorinated EP additive. The tertiary-nonyl polysulfide used is Atochem TPS-20.

TABLE III

EP Testing Results with Valvoline automatic transmission fluid (ATF)

| Run | Friction-Reducing EP oil blends | Failure loads in lbs |
|---|---|---|
| 1 | 100% ATF fluid | Failed at 1 lb load |
| 2 | 90% ATF fluid + 5% Doverlube NCEP + 5% tert-nonylpolysulfide (20% S) | Failed at 9 lbs load |

Thus, we see the lubricating improvement with the nitro NCEP and polysulfide in automatic transmission fluid as well.

These nitro or nitrated additives can be combined with other extreme-pressure or lubricity additives and be used in straight oil formulations or even in water-based, soluble oil formulations. Other extreme-pressure additives can be combined with the nitrated additives, and can include blends with chlorine-, sulfur- and phosphorus-containing compounds in which case the nitrated additive acts as a partial replacement for traditional lubricant additives.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the invention is by way of example, and the scope of the invention is not limited to the exact details shown or described.

This invention has been described in detail with reference to specific embodiments thereof, including the respective best modes for carrying out each embodiment. It shall be understood that these illustrations are by way of example and not by way of limitation.

What is claimed is:

1. A process for reducing friction in an oil-lubricated application using a blend of at least one nitrated moiety with at least one other moiety containing sulfur, phosphorus or combinations thereof comprising the steps of:

adding to an hydrocarbon oil of lubricating viscosity from about 2% to 75% by weight of an additive comprising:

at least one nitrated soybean oil, formed by reacting with a nitrating agent selected from the group consisting of nitric acid and nitrogen dioxide, and adding at least one non-chlorine containing moiety to said additive, a combination of said non-chlorine containing moiety and said nitrated soybean oil, improving a performance of said additive in at least one physical characteristic when compared to using said additive without said combination, said at least one non-chlorine containing moiety selected from the group consisting of a sulfur-containing moiety, a phosphorus-containing moiety and a moiety containing both sulfur and phosphorus, and further wherein said sulfur-containing moiety comprises at least one of an alkyl sulfamate, an alkyl sulfonate and a polysulfide and wherein said phosphorus-containing moiety comprises at least one of a phosphate ester and an phosphite and wherein said moiety containing both sulfur and phosphorus comprises at least one of a thiophosphate, a zinc thiophosphate and a zinc dithiophosphate.

2. A process for reducing friction in an oil-lubricated application using a blend of at least one nitrated moiety with at least one other moiety containing sulfur, phosphorus or combinations thereof comprising the steps of:

adding to an hydrocarbon oil of lubricating viscosity from about 2% to 75% by weight of an additive comprising:

at least one nitrated reaction product of an ester blend of a polyol and an unsaturated fatty acid, formed by reacting with a nitrating agent selected from the group consisting of nitric acid and nitrogen dioxide, and adding at least one non-chlorine containing moiety to said additive, a combination of said non-chlorine containing moiety and said at least one nitrated reaction product of an ester blend of a polyol and an unsaturated fatty acid, improving a performance of said additive in at least one physical characteristic when compared to using said additive without said combination, said at least one non-chlorine containing moiety selected from the group consisting of a sulfur-containing moiety, a phosphorus-containing moiety and a moiety containing both sulfur and phosphorus, and further wherein said sulfur-containing moiety comprises at least one of an alkyl sulfamate, an alkyl sulfonate and a polysulfide and wherein said phosphorus-containing moiety comprises at least one of a phosphate ester and a phosphite and wherein said moiety containing both sulfur and phosphorus comprises at least one of a thiophosphate, a zinc thiophosphate and a zinc dithiophosphate.

3. A process for reducing friction in an oil-lubricated application using a blend of at least one nitrated moiety with at least one other moiety containing sulfur, phosphorus or combinations thereof comprising the steps of:

adding to an hydrocarbon oil of lubricating viscosity from about 2% to 75% by weight of an additive comprising:

at least one nitrated unsaturated fatty acid formed by reacting with a nitrating agent selected from the group consisting of nitric acid and nitrogen dioxide, and adding at least one non-chlorine containing moiety to said additive, a combination of said non-chlorine containing moiety and said nitrated unsaturated fatty acid, improving a performance of said additive in at least one physical characteristic when compared to using said additive without said combination, said at least one non-chlorine containing moiety selected from the group consisting of a sulfur-containing moiety, a phosphorus-containing moiety and a moiety containing both sulfur and phosphorus, and further wherein said sulfur-containing moiety comprises at least one of an alkyl sulfamate, an alkyl sulfonate and a polysulfide and wherein said phosphorus-containing moiety comprises at least one of a phosphate ester and a phosphite and wherein said moiety containing both sulfur and phosphorus comprises at least one of a thiophosphate, a zinc thiophosphate and a zinc dithiophosphate.

* * * * *